US007287743B1

(12) United States Patent
Gliniecki

(10) Patent No.: US 7,287,743 B1
(45) Date of Patent: Oct. 30, 2007

(54) CARBURETOR WITH AN AIR BLEED PASSAGE

(75) Inventor: Gary U. Gliniecki, Ruth, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 302 days.

(21) Appl. No.: 11/075,108

(22) Filed: Mar. 8, 2005

(51) Int. Cl.
*F02M 7/24* (2006.01)

(52) U.S. Cl. ..... 261/55; 261/63; 261/121.3; 261/121.4

(58) Field of Classification Search ..... 261/35, 261/46, 55, 63, 121.3, 121.4
See application file for complete search history.

(56) References Cited

U.S. PATENT DOCUMENTS 2,656,166 A * 10/1953 Foster ..... 261/41.5
2,807,449 A * 9/1957 Manning, Jr. ..... 261/41.5
3,425,672 A * 2/1969 Seigel et al. ..... 261/23.2
3,549,133 A * 12/1970 Frankowski et al. ..... 261/51
3,743,254 A * 7/1973 Tuckey ..... 261/34.2
4,122,809 A * 10/1978 Iwasa ..... 123/678
4,175,103 A * 11/1979 Stoltman ..... 261/50.1
4,178,332 A * 12/1979 Hogeman et al. ..... 261/50.1
4,190,618 A * 2/1980 Sheffer ..... 261/50.1
4,217,314 A * 8/1980 Dysarz ..... 261/50.1
4,276,238 A * 6/1981 Yoshikawa et al. ..... 261/39.5
6,536,747 B2 3/2003 Burns et al. ..... 261/35

FOREIGN PATENT DOCUMENTS

JP 54-55242 A * 5/1979 ..... 261/121.4

* cited by examiner

*Primary Examiner*—Richard L. Chiesa
(74) *Attorney, Agent, or Firm*—Reising, Ethington, Barnes, Kisselle, P.C.

(57) ABSTRACT

A carburetor for use with an internal combustion engine has a fuel and air mixing passage, a choke valve with a valve head disposed at least partially in the fuel and air mixing passage and an air bleed passage with at least a portion that is communicated with the choke valve head when the choke valve is in its closed position to at least partially restrict air flow out of the air bleed passage when the choke valve is closed. The air bleed passage preferably provides air to a fuel circuit of the carburetor when the choke valve is open. When the choke valve is closed the air flow through the air bleed passage to the fuel circuit is at least partially restricted to provide a richer fuel and air mixture to the engine during a choke assisted start and warming up of the engine.

13 Claims, 2 Drawing Sheets

CARBURETOR WITH AN AIR BLEED PASSAGE

FIELD OF THE INVENTION

This invention generally relates to a carburetor for a combustion engine and, more particularly, to an air bleed control system for a carburetor to facilitate quick starting and warm-up of combustion engines.

BACKGROUND OF THE INVENTION

Diaphragm carburetors are commonly used to provide the fuel requirements for two and four cycle internal combustion engines such as those typically found in hand-operated fuel-powered devices such as chainsaws, weed cutters/trimmers, lawn mowers and the like. A choke valve is often incorporated in the diaphragm carburetor when the carburetor is used in hand-operated devices having engines that operate under "cold start" conditions. The choke valve is located within a fuel and air mixing passage between a venturi and an inlet for air. The choke valve generally includes a plate that can be rotated between closed and opened positions as known in the art.

In some diaphragm carburetors, air flows into the fuel and air mixing passage and into an air bleed passage that connects with a fuel chamber to provide additional air to be mixed with the fuel thereby providing a leaner fuel and air mixture. A separate air bleed shut-off valve has been provided to selectively prevent communication between the air bleed passage and the fuel chamber so that a richer fuel and air mixture is delivered to the engine, for example, to facilitate starting and warming up a cold engine. The air bleed shut-off valve adds components, complexity and cost to the carburetor in that they must be mounted in the air bleed passage, and can require separate actuation that complicates an engine starting procedure.

SUMMARY OF THE INVENTION

A carburetor for use with an internal combustion engine has a fuel and air mixing passage, a choke valve with a valve head disposed at least partially in the fuel and air mixing passage and an air bleed passage with at least a portion that communicates with the choke valve head when the choke valve is in its closed position to at least partially restrict air flow out of the air bleed passage when the choke valve is closed. The air bleed passage preferably provides air to a fuel circuit of the carburetor when the choke valve is open. When the choke valve is closed the air flow through the air bleed passage to the fuel circuit is at least partially restricted to provide a richer fuel and air mixture to the engine during a choke assisted start and warming up of the engine.

In one presently preferred implementation, at least a portion of the air bleed passage is formed in a nub carried by the carburetor body. The nub preferably projects into the fuel and air mixing passage and may provide a positive stop for the choke valve in its closed position. The choke valve head may abut the nub when the choke valve is closed to at least substantially close the air bleed passage.

Objects, features and advantages of this invention include providing a carburetor that is capable of delivering a richer fuel and air mixture during a choke assisted start and operation of an engine, provides an air bleed when the engine is operating with the choke valve open, provides automatic restriction of an air bleed when a choke valve is closed, permits control over the air flow rate in the air bleed, has relatively few parts, is of relatively simple design, and economical manufacture and assembly, is durable, reliable, requires very little maintenance and adjustment in use, and has a long useful operating life.

BRIEF DESCRIPTION OF THE DRAWINGS

These and other objects, features and advantages of this invention will be apparent from the following detailed description, appended claims, and accompanying drawings in which:

DETAILED DESCRIPTION OF THE PREFERRED EMBODIMENT

Figure 1:
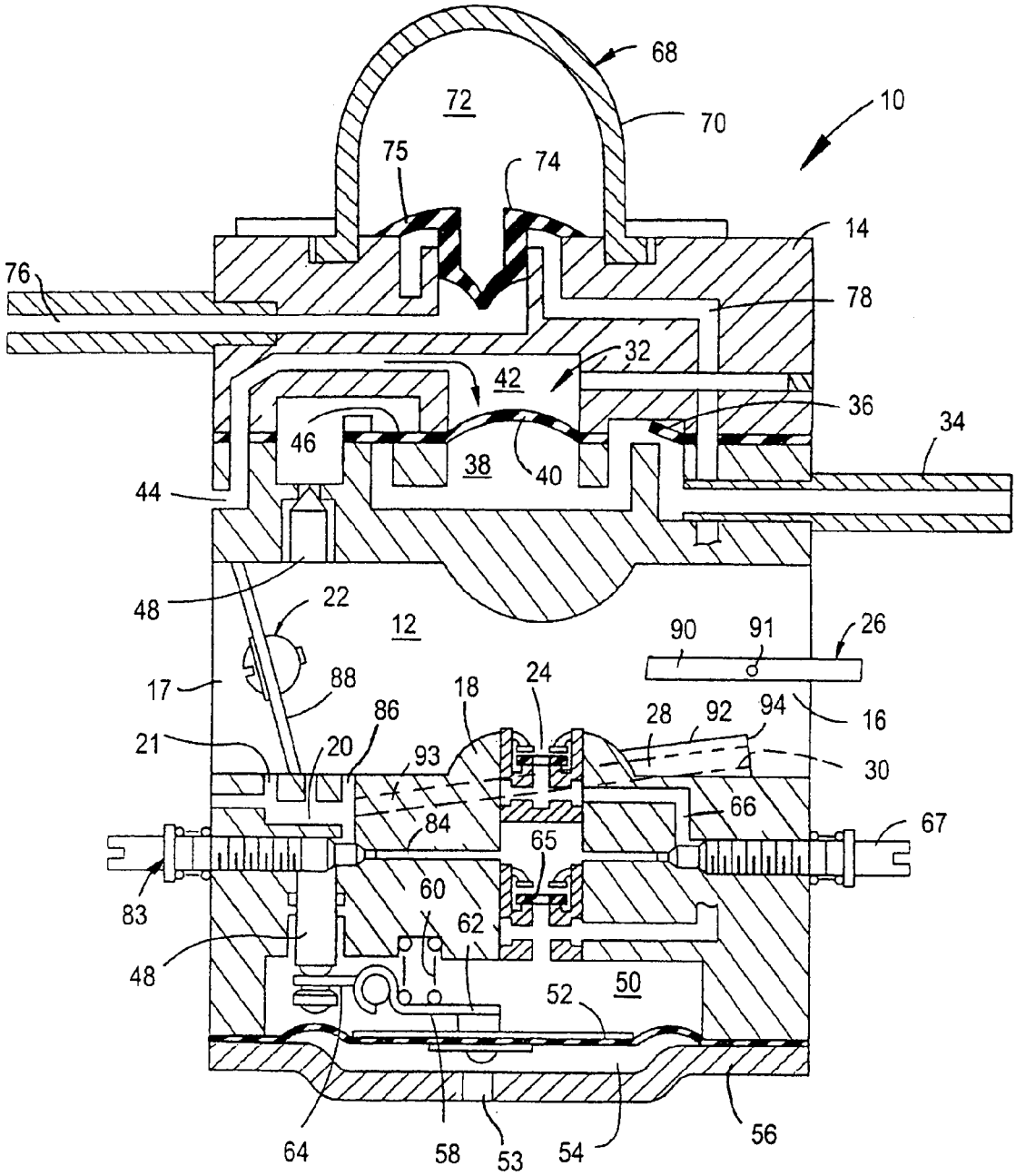
FIG. 1 is a cross-sectional side view of one presently preferred embodiment of a diaphragm carburetor showing an air bleed passage and a choke valve in an open position.
Figure 2:
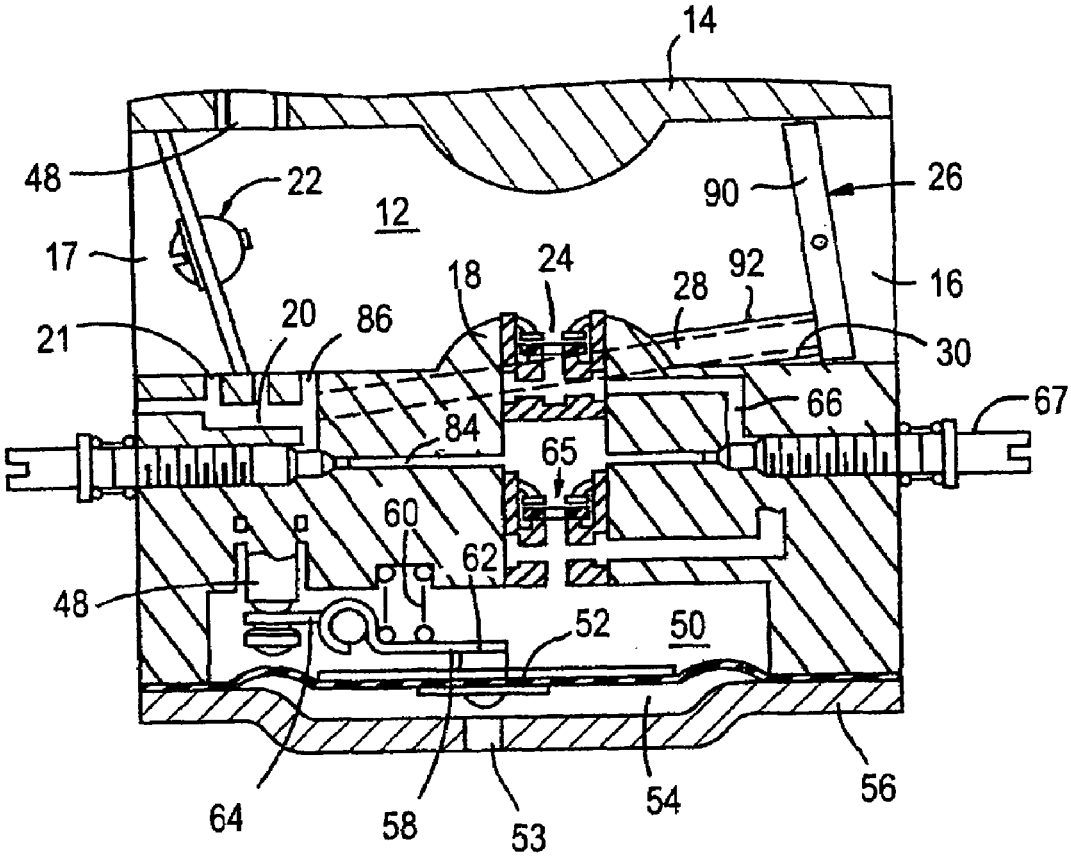
FIG. 2 is a fragmentary cross-sectional side view of the diaphragm carburetor of FIG. 1 showing the choke valve in a closed position.

Referring in more detail to the drawings, FIGS. 1 and 2 illustrate one presently preferred embodiment of a diaphragm carburetor 10. The carburetor 10 provides a fuel and air mixture to an engine to support operation of the engine and includes an air bleed passage 28 that is open during normal operation and restricted or closed during choke assisted starting and choke assisted engine operation to provide a richer fuel and air mixture to the engine when a choke valve 26 of the carburetor is closed. The choke valve 26 is disposed in a fuel and air mixing passage 12 that is formed in and extends through a carburetor body 14, and includes an inlet end 16, an outlet end 17 and preferably a venturi section 18 between the ends 16, 17. Fuel is delivered into the mixing passage through a fuel circuit including a main nozzle 24, and one or more low speed or idle nozzles 21. The fuel is mixed with air flowing through the mixing passage 12 and is delivered to an engine to support combustion in the engine. The choke valve 26 is rotatable between an open position permitting a substantially unrestricted air flow to the venturi 18 and a closed position substantially restricting the flow of air to the venturi 18. The carburetor also includes a throttle valve disposed in the mixing passage 12 and rotatable between an idle position substantially restricting fluid flow out of the mixing passage outlet end 17 and a wide open position permitting a substantially unrestricted flow out of the outlet end 17. The diaphragm carburetor 10 is particularly useful for small two and four-cycle engine applications but can, otherwise, be applied in float-type carburetors for either two or four-stroke engines of varying sizes.

As shown in FIG. 1, a diaphragm fuel pump 32 is carried by the body 14 and receives fuel from a remote fuel reservoir or tank (not shown) that is connected to a fuel inlet 34 that leads to an inlet check valve 36 and a pump chamber 38 defined in part by a diaphragm 40 of the pump 32. Air pressure pulses generated by the engine are communicated through an inlet port 44 and into to an air chamber 42 defined on the other side of the diaphragm 40 from the pump chamber 38. The diaphragm 40 is flexed, vibrated or reciprocated in response to the pressure pulses and thereby changes the volume of the pump chamber 38 to draw fuel into the pump chamber through the inlet check valve 36 and discharge fuel from the pump chamber 38 through an outlet check valve 46, past an inlet metering valve 48, and into a fuel metering chamber 50. The metering chamber 50 is defined by the body 14 and a metering diaphragm 52 which also defines a reference chamber 54 that is communicated with the atmosphere through a vent 53 in a cover plate 56 that traps the periphery of the diaphragm 52 against the carburetor body 14. A substantially constant pressure is maintained within the metering chamber 50 to facilitate providing a metered fuel flow rate to the mixing passage 12 as is known. In response to a subatmospheric pressure in the metering chamber 50, the metering diaphragm is displaced toward a pivot arm 58 and engages an end 62 of that arm to rotate it against the force of a spring 60 and thereby moves the other end 64 of the arm 58 which is coupled to the metering valve 48 to open the metering valve 48 and permit fuel from the fuel pump to enter the metering chamber 50. This increases the pressure in the metering chamber 50 and displaces the metering diaphragm 52 away from the arm 58. When the pressure in the metering chamber 50 increases sufficiently, the metering valve 48 will close to prevent additional fuel from flowing into the metering chamber 50. Fuel flows from the metering chamber 50 to the fuel and air mixing passage 12 in response to a difference between the pressure in the metering chamber 50, which is typically at or near atmospheric pressure, and the sub-atmospheric pressure prevailing in the mixing passage 12 during normal operation.

Without cranking or running the engine, the diaphragm pump 32 does not receive the engine pressure pulses necessary to pump fuel from the reservoir into the metering chamber 50. Therefore, a manually operated priming pump 68 is incorporated into the carburetor to remove vapors, air and stale fuel from the metering chamber 50 and/or the fuel pump chamber 38. The priming pump 68 has a domed cap 70 made of a resilient material such as Neoprene rubber which defines a pump chamber 72 located generally at the top of the body 14. A mushroom shaped dual action check valve 74 is disposed within pump chamber 72. When the resilient dome cap 70 is initially depressed, fluid is expelled from the chamber 72 through the center of the check valve 74 and through an atmospheric outlet port 76. As the dome cap 70 is released and expands to its original state, the resultant pressure drop produced within the chamber 72 pulls an annular peripheral flap 75 of the check valve 74 upward and fluid moves toward the chamber 72 through a passage 78 which communicates with the fuel metering chamber 50. Repeated actuation of the priming pump 68 may be employed to remove air or fuel vapor from the metering chamber 50 and the pump chamber 38 to facilitate initial cranking and cold start of the engine.

During warm or cold idling conditions of the engine, the throttle valve 22 is in its idle position which is substantially and typically about ninety-five percent closed. This closure greatly restricts air flow through the mixing passage 12 and the running engine produces a large pressure drop downstream of the throttle valve 22 which moves fuel from the metering chamber 50 through a low speed portion of the fuel circuit which includes an emulsifying chamber 20 that leads to the low speed nozzle 21 disposed downstream of the throttle valve 22 (when the throttle valve 22 is in its idle position). Prior to discharge of the fuel necessary for engine idling, the fuel first flows into the emulsifying chamber 20 from the metering chamber 50, and the rate or quantity of this fuel flow is controlled via an adjustable low speed needle valve 83, which is partially received in a low speed fuel channel 84 communicating between the two chambers 50 and 20.

To enhance fuel mixing, one or more acceleration ports 86 communicate between the mixing passage 12, upstream of throttle valve 22, and the emulsifying chamber 20. The ports 86 allow a portion of the total engine idling air flow to bypass the throttle valve 22, wherein the bypassed air flow mixes with the fuel within the emulsifying chamber 20 producing a rich fuel and air mixture that is discharged into the mixing passage 12 through the idling nozzle 21 for mixing with the remainder of the engine idling air flow. The ports 86 are preferably aligned along the axis of the passage 12 and within the sweeping action of a plate 88 of the throttle valve 22. As the throttle valve 22 opens, the plate 88 sweeps past the ports 86, one by one, reducing the air pressure differential or vacuum downstream of the throttle valve 22. This reduces air flow and mixing within the emulsifying chamber 20, and the overall fuel contribution therefrom. At throttle valve positions sufficiently off idle, the primary fuel flow into the fuel and air mixing passage occurs through a high speed fuel circuit that includes the main nozzle 24 which communicates with the metering chamber through a fuel jet 65, fuel passages 66 and a high speed fuel metering needle valve 67.

The choke valve 26 is disposed within the passage 12 between the inlet 16 and the venturi 18 and upstream of the throttle valve 22. The choke valve 26 has a valve head such as a thin butterfly valve-type plate 90 mounted on a shaft 91 that extends into the mixing passage 12. The shaft 91 is rotatable to move the plate 90 between an open position permitting a substantially unrestricted flow of air through the mixing passage 12, and a closed position at least substantially restricting the flow of air through the mixing passage 12.

The air bleed passage 28 has an inlet end 30 that preferably is open to the fuel and air mixing passage 12 in the area of the inlet end 16, and an outlet end 93 communicating with the emulsifying chamber 20. As shown in FIG. 1, the air bleed passage 28 is formed at least in part in the body 14 of the carburetor 10, and may be a straight drilled hole or other passage arrangement. In one presently preferred implementation, the inlet end 30 of the air bleed passage is formed in a nub 92 in the body 14 that preferably extends or opens into the fuel and air mixing passage 12 and is adhered or welded to, carried by or integrally formed with the body 14 by way of examples without limitation. The nub 92 preferably includes an end face 94 at its inlet 30 that is generally planar and is oriented at generally the same angle that the choke valve plate 90 is in when the choke valve is closed. The nub 92 may include a restriction that is smaller in flow area than the remainder of the air bleed passage to control the flow rate of air in the air bleed passage without having to form the entire passage 28 with a small diameter. Alternatively, the inlet 30 of the air bleed passage 28 may extend out of the fuel and air mixing passage 12 to an air filter housing adjacent to or remote from the carburetor 10 or any other variety of external clean air sources by utilizing an external tube as part of the air bleed passage 28 and a remote restricting valve mounted thereon (not shown).

As shown in FIG. 1, when the choke valve 26 is open, air flows through the air bleed passage 28 to the emulsifying chamber 20. During cold engine start and idle conditions when the choke valve is rotated to its closed position (FIG. 2), the choke valve plate 90 at least partially blocks, restricts or closes the inlet 30 of the air bleed passage 28 at least restricting and possibly preventing any air flow to the emulsifying chamber 20 through the air bleed passage 28. The choke valve plate 90 may abut the nub 92 when closed to provide a positive stop and control the orientation of the choke valve 26 when it is in its closed position so that other control or limiter of movement of the choke valve toward its closed position is not needed. The choke valve plate 90 may be slightly spaced from the inlet 30 of the air bleed passage 28 while still sufficiently restricting air flow into the air bleed passage 28. Without the additional air or with a restricted air flow from the air bleed passage when the choke valve is closed, a richer fuel and air mixture may be supplied to the engine to facilitate starting and warming up the engine. Once the engine has warmed up, the rich mixture is no longer needed to sustain engine operation and the choke valve 26 can be opened thereby permitting air flow through the air bleed passage 28 and to the emulsifying chamber 20.

While in the presently preferred embodiment shown and described the air bleed passage 28 communicates with the emulsifying chamber 20, the air bleed passage may also or otherwise communicate with other portions of the fuel circuit, including in the area of the main fuel nozzle 24, or any other desired portion, chamber or passage of the fuel circuit, or any passage through which fuel is added to the mixing passage.

While the forms of the invention herein disclosed constitute a presently preferred embodiment, many others are possible. It is not intended herein to mention all the possible equivalent forms or ramifications of the invention. It is understood that terms used herein are merely descriptive, rather than limiting, and that various changes may be made without departing from the spirit or scope of the invention as defined by the following claims.

The invention claimed is:

1. A carburetor for use with an internal combustion engine comprising:

a fuel and air mixing passage having an inlet and an outlet through which a fuel and air mixture is delivered to the engine;

a fuel circuit that communicates a supply of fuel with the fuel and air mixing passage;

a choke valve having a valve head disposed at least partially in the fuel and air mixing passage in the area of the inlet and movable between an open position and a closed position to restrict air flow through the fuel and air mixing passage; and an air bleed passage having an inlet in communication with the fuel and air mixing passage, an outlet in communication with a portion of the fuel circuit upstream of the fuel and air mixing passage to provide in operation air to said portion of the fuel circuit when the choke valve is in its open position, and the inlet is at least partially closed by the valve head when the choke valve is in its closed position in operation to at least substantially restrict air flow into the inlet and through the air bleed passage when the choke valve is closed.

2. The carburetor of claim 1 wherein the inlet of the air bleed passage is formed in a nub that extends at least partially into the fuel and air mixing passage.

3. The carburetor of claim 2 which also comprises a body of the carburetor in which the fuel and air mixing passage is formed and wherein the nub is carried by the body.

4. The carburetor of claim 3 wherein the nub is integrally formed with the body.

5. The carburetor of claim 3 wherein the choke valve head includes a valve plate that abuts the nub when the choke valve is in its closed position.

6. The carburetor of claim 1 which also comprises an idling nozzle in communication with the fuel circuit and through which fuel is supplied to the fuel and air mixing passage at engine idle and other relatively low load engine operating conditions, and wherein the fuel circuit includes an emulsifying chamber that communicates with the idling nozzle and the air bleed passage outlet communicates with the emulsifying chamber.

7. A carburetor for use with an internal combustion engine comprising:

a fuel and air mixing passage having an inlet and an outlet through which a fuel and air mixture is delivered to the engine;

a choke valve having a valve head disposed at least partially in the fuel and air mixing passage in the area of the inlet and movable between an open position and a closed position to restrict air flow through the fuel and air mixing passage;

an emulsifying chamber that communicates with the fuel and air mixing passage and is constructed to receive fuel and air for producing a mixture thereof to be supplied to the fuel and air mixing passage; and an air bleed passage having an inlet in communication with the fuel and air mixing passage, an outlet in communication with the emulsifying chamber, and the inlet is at least partially closed by the choke valve head when the choke valve is in its closed position in operation to at least substantially restrict air flow through the inlet and air bleed passage to the emulsifying chamber when the choke valve is closed.

8. The carburetor of claim 7 wherein the inlet of the air bleed passage is formed in a nub that extends at least partially into the fuel and air mixing passage.

9. The carburetor of claim 8 which also comprises a body of the carburetor in which the fuel and air mixing passage is formed and wherein the nub is integrally formed with the body.

10. The carburetor of claim 8 wherein the valve head comprises a choke valve plate and the nub includes an end face that is oriented at an angle that is generally the same angle as the choke valve plate when the choke valve plate is in its closed position.

11. The carburetor of claim 8 wherein the choke valve head includes a valve plate that abuts the nub when the choke valve is in its closed position.

12. The carburetor of claim 11 wherein the valve plate substantially closes the inlet of the air bleed passage when the choke valve is in its closed position.

13. A carburetor for an internal combustion engine comprising:

a body;

a fuel and air mixing passage carried by the body and having an inlet through which air is received and an outlet through which a fuel and air mixture is delivered to the engine;

a choke valve carried by the body and having a valve head disposed at least partially in the fuel and air mixing passage adjacent the inlet and movable between a closed position restricting air flow through the air and fuel mixing passage and an open position;

a fuel circuit for supplying fuel to the fuel and air mixing passage downstream of the choke valve head when in the closed position of the choke valve;

an air bleed passage having an inlet in communication with the fuel and air mixing passage and an outlet in communication with a portion of the fuel circuit upstream of the fuel and air mixing passage to provide in operation air to such portion of the fuel circuit; and the valve head and the inlet of the air bleed passage being constructed and arranged so that in operation when the choke valve is in its closed position, the valve head at least partially closes the inlet to at least substantially restrict air flow into the inlet and through the bleed passage and when the choke valve is open air flow into the inlet and through the air bleed passage is not restricted by the valve head.

* * * * *